US006059671A

United States Patent [19]

Asakura

[11] Patent Number: 6,059,671

[45] Date of Patent: May 9, 2000

[54] GOLF BALL

[75] Inventor: Takeshi Asakura, Fukuchiyama, Japan

[73] Assignee: Sumitomo Rubber Industries, Ltd., Kobe, Japan

[21] Appl. No.: 09/069,199

[22] Filed: Apr. 29, 1998

[30] Foreign Application Priority Data

Jul. 31, 1997 [JP] Japan ..... 9-220658

[51] Int. Cl.[7] ..... A63B 37/14

[52] U.S. Cl. ..... 473/383

[58] Field of Search ..... 473/383, 384

[56] References Cited

U.S. PATENT DOCUMENTS 5,005,838 4/1991 Oka ..... 473/384

FOREIGN PATENT DOCUMENTS 2551048 8/1996 Japan .
2654058 5/1997 Japan .

*Primary Examiner*—George J. Marlo
*Attorney, Agent, or Firm*—Armstrong, Western, Hattori, McLeland & Naughton

[57] ABSTRACT

A golf ball has plural dimples on its surface. Each dimple has a dimple deepest portion not corresponding to a center of the dimple as viewed in radial direction toward a center of the golf ball. A cross acute angle, between, a straight line which goes through the dimple deepest portion and the center of the dimple, and a great circle zone which goes through poles and the center of the dimple, is arranged to be −85° to 85°. The dimple deepest portion is positioned nearer to a seam than the center of the dimple and the depth of the dimple diminishes gradually and monotonically from the deepest portion to a radially outer portion.

9 Claims, 3 Drawing Sheets

GOLF BALL

BACKGROUND OF THE INVENTION

1. Field of the Invention

This invention relates to a golf ball.

2. Description of the Related Art

A golf ball dimple plays two roles in flight of a golf ball. In one role, the dimple promotes turbulent transition on boundary layer of the golf ball with disturbing air flow around the golf ball, causes turbulent separation, and reduces pressure drag with separation point of turbulence moved backward thereby. In the other role, the dimple increases lift of the golf ball by promotion of locational difference between an upper separation point and a lower separation point to a flying direction of the golf ball. That is to say, the more a dimple disturbs air flow around a golf ball, the more advanced aerodynamically the dimple becomes.

In view of the roles of dimples described above, combinations of dimples of various configurations have been conventionally proposed to disturb air flow around a golf ball. For example, a golf ball having dimples of which configuration is pentagonal or hexagonal, a golf ball having dimples of which cross-sectional configuration is formed with two curved surfaces having different curvatures (i.e. double-radius), and a combination of circular dimples and non-circular dimples, are proposed.

In conventional products described above, however, effect of disturbing air flow around a golf ball is not sufficient, and desired flying distance is not obtained.

A golf ball is generally formed with a pair of upper and lower half mold, and dimples can not be disposed on the parting line which is the junction line of the mold. Therefore, on the surface of the golf ball, a great circle path (great circle zone) which does not cross dimples is formed.

And, a golf ball flies with back spin in case of being hit by a golf club. It is preferable that the golf ball always flies similarly wherever a rotational axis of the back spin is situated in the golf ball. That is to say, it is preferable that height of trajectory, flying time, and flying distance are same wherever a rotational axis of the back spin is situated in the golf ball. With the great circle path, however, effect of dimples in case of that the rotational axis corresponds to the above mentioned great circle path (in case of so-called seam-hitting) is different from effect of dimples in case of that the rotational axis does not correspond to the great circle path (in case of so-called pole-hitting).

As described above, if the discrepancy of flying ability of the golf ball is caused by the difference of the rotational axis based on the difference among hitting points on the golf ball, the golf ball has bad aerodynamic symmetrical quality, and can not reflect players' skill accurately.

It is therefore an object of the present invention to provide a golf ball which has sufficient effect of disturbing air flow around the golf ball, and can obtain desired flying distance. And it is another object of the present invention to provide a golf ball which has good aerodynamic symmetrical quality, and has no discrepancy of trajectory between in seam-hitting and in pole-hitting.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
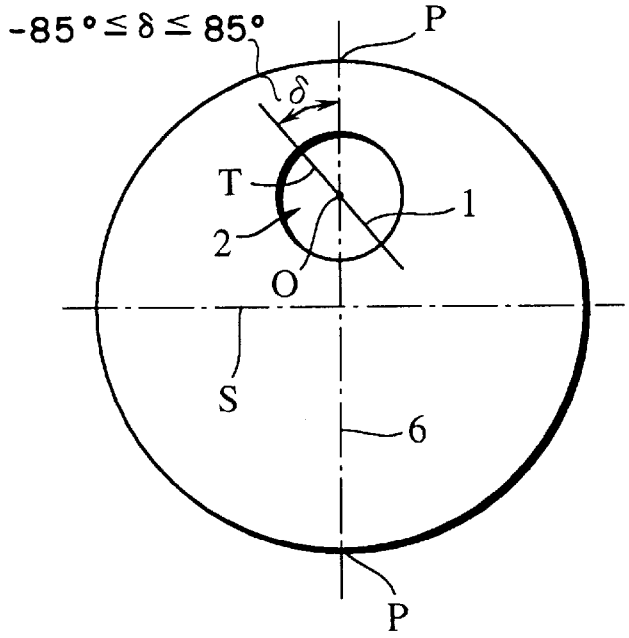
FIG. 1 is a schematic view of a golf ball according to the present invention.

FIG. 1 shows a golf ball according to the present invention. This golf ball is provided with many dimples 2. In FIG. 1, only one dimple 2 is indicated for simplification of the Figure.

Figure 2A:
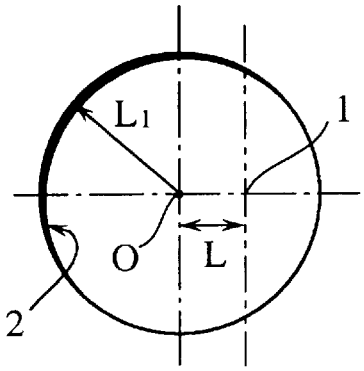
FIG. 2A is a top view of a dimple.
Figure 2B:
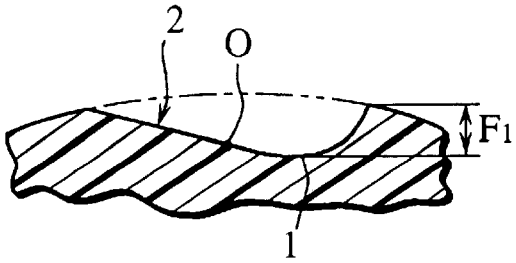
FIG. 2B is a cross-sectional view of a dimple and the depth of the dimple diminishes gradually and monotonically from the deepest portion to a radially outer portion.

The dimple 2 is circular and a dimple deepest portion 1 is arranged not to correspond to a center O of the dimple in a dimple plane view (dimple plane view means a view of the dimple 2 as viewed in radial direction toward the center of the golf ball). In other words, the dimple deepest portion 1 and the center O of the dimple are arranged not to correspond each other when they are projected on a spherical surface (surface of the golf ball). That is to say, as shown in FIG. 2, the dimple deepest portion 1 deviates from the center O of the dimple for a dimension L.

Thus, when the dimple deepest portion 1 is arranged not to correspond to the center O of the dimple, an angle between a slope of the dimple and a land of the golf ball is changeable in the same dimple, it becomes possible to enhance air scraping effect thereby in comparison with the effect in a conventional dimple in which the angle between the slope and the land is not changeable in the same dimple, air flow around the golf ball is more greatly disturbed, and aerodynamic characteristics of the golf ball can be improved.

And, as shown in FIG. 1, a straight line T which goes through the dimple deepest portion 1 and the center O of the dimple is at a predetermined angle with a great circle zone (great circle path) 6 which goes through two poles P and the center O of the dimple, and the dimple deepest portion 1 is positioned nearer to a seam S than the center O of the dimple. The difference between pole-hitting and seam-hitting diminishes thereby, the discrepancy of flying ability of the golf ball caused by the difference of the rotational axis based on the difference among hitting points on the golf ball disappears, and the golf ball has a good aerodynamic symmetrical quality.

The predetermined angle, namely, a cross acute angle $\delta$ is arranged to be −85° to 85°. That is to say, the cross acute angle $\delta$ is measured with the great circle zone 6 as the center, one side to the great circle zone 6 is +, and the other side to the great circle zone 6 is −, and the cross acute angle $\delta$ of 0° to 85° is on either one side or the other side to the great circle zone 6. The cross acute angle $\delta$ is arranged to be within the above range, because if the cross acute angle $\delta$ is over 85°, it is hardly said that the dimple deepest portion 1 is arranged nearer to the seam S than the center O of the dimple.

Figure 3A:
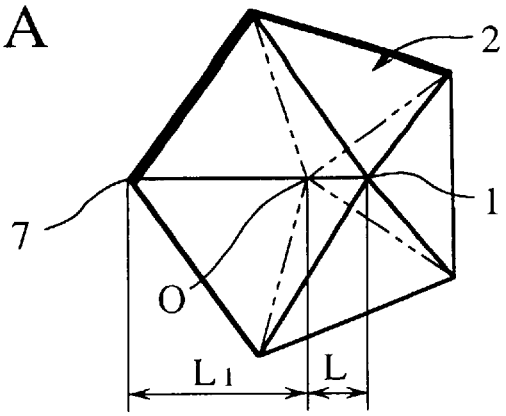
FIG. 3A is a top view of another dimple.
Figure 4A:
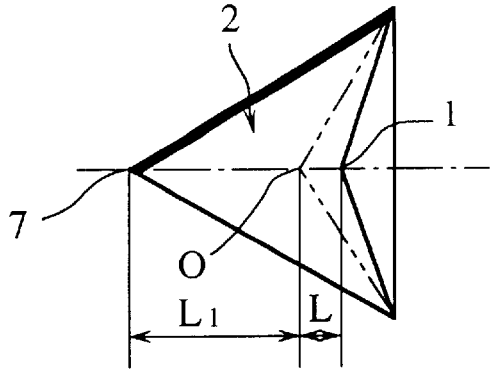
FIG. 4A is a top view of a further dimple.
Figure 4B:
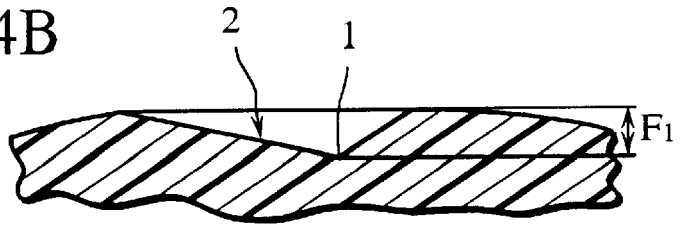
FIG. 4B is a cross-sectional view of a further dimple.
Figure 5A:
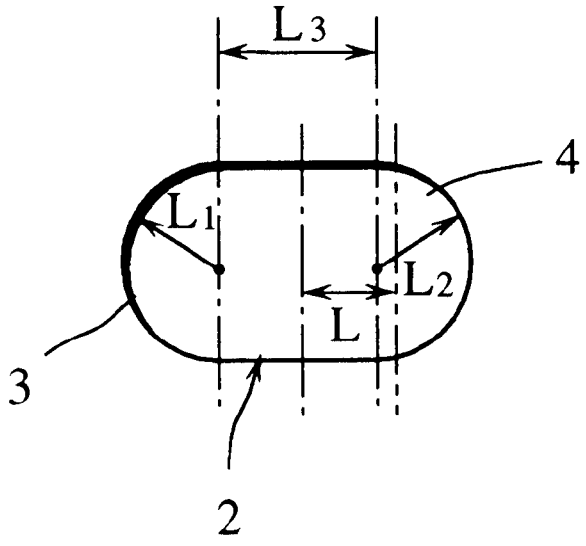
FIG. 5A is a top view of a still further dimple.
Figure 5B:
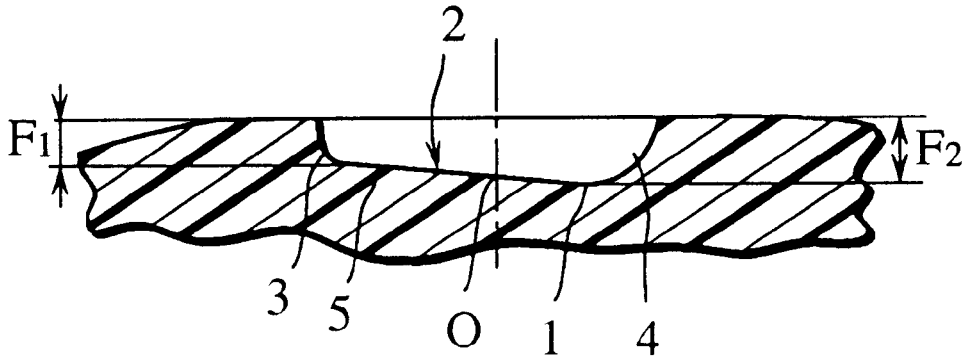
FIG. 5B is a cross-sectional view of a still further dimple.

As shape of the dimple 2 in the dimple plane view, besides circular shape as shown in FIG. 1 and FIG. 2, various kinds of shapes shown in FIG. 3A etc. may be used. The shape of the dimple 2 shown in FIG. 3A and FIG. 3B is regular pentagonal, the shape of the dimple 2 shown in FIG. 4A and FIG. 4B is regular triangular, and the shape of the dimple 2 shown in FIG. 5A and FIG. 5B is elliptic.

Figure 3B:
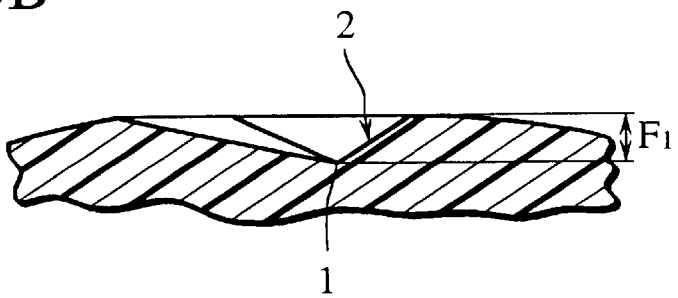
FIG. 3B is a cross-sectional view of another dimple.

Concretely, in case of a regular pentagon shown in FIG. 3A and FIG. 3B, the dimple deepest portion 1 is on an extension of a line which goes through an apex 7 and the center O of the dimple. In case of a regular triangle shown in FIG. 4A and FIG. 4B, the dimple deepest portion 1 is also on an extension of a line which goes through an apex 7 and the center O of the dimple. In case of a ellipse shown in FIG. 5A and FIG. 5B, a bottom face of the dimple comprises a shallow arc portion 3 on one side, and another deep arc portion 4 on the other side, and a slope portion 5 which becomes deep gradually from the arc portion 3 on one side to the arc portion 4 on the other side. FIG. 3A, FIG. 4A, and FIG. 5A show the shape of the dimple in the dimple plane view. FIG. 3B, FIG. 4B, and FIG. 5B show sectional shape of the dimple.

As the golf ball relating to the present invention, various kinds of balls such as one-piece balls, wound core balls, solid balls of multilayer structure etc. may be used. And the number of dimples is, for example, arranged to be 300 to 600 preferably, although the number is not limited to this range.

A golf ball may be provided with plural kinds of dimples 2 of different shapes and sizes. And the shape of the dimple 2, not being restricted to the shapes shown in the Figures, may be regular hexagonal or polygonal of more than seven angles in the dimple plane view. A deviational dimension L of the dimple deepest portion 1 from the center o of the dimple is, for example, arranged to be 0.2 mm to * mm. In this case, *mm means (radius×0.9)mm if the shape of the dimple is circular, (major radius×0.9)mm if the shape of the dimple is elliptic, and (length from an apex to the center×0.9)mm if the shape of the dimple is triangular or other polygonal. That is to say, if the deviational dimension L is less than 0.2 mm, an angle between the slope of the dimple and the land of the golf ball is not so changeable in the same dimple, and air scraping effect can not be so improved. Reversely, if the deviational dimension L is over *mm, the angle between the slope of the dimple and the land of the golf ball is changed too much in the same dimple, and it is not desirable.

And, the above-described dimple 2 may be also disposed on the golf ball mixed with conventional dimples (having dimple deepest portions corresponding to centers of the dimples), with arranging number of the dimple 2 as to be more than 50% of total number of dimples. The number of the dimple 2 is more than 50% of the total number of dimples because if the number of the dimple 2 having the dimple deepest portion 1 not corresponding to the center O of the dimple is less than 50% of the total number of dimples, the effect of disturbing air flow around the golf ball is not greatly increased in comparison with that of conventional golf balls, and it is not desirable. And, it is preferable to arrange the number of the dimple 2 to be more than 90% of the total number of dimples for further effect of disturbing air flow around the golf ball.

Next, examples of the present invention will be described.

Various kinds of golf balls are formed with combinations of various kinds of dimples shown in Table 1, performance capability of each golf ball is tested, and its result is shown in Table 2.

TABLE 1

| Kind of Dimple | Plane Shape of Dimple | Sectional Shape of Dimple | $L_1$ (mm) | $L_2$ (mm) | $L_3$ (mm) | L (mm) | $F_1$ (mm) | $F_2$ (mm) |
|---|---|---|---|---|---|---|---|---|
| A | Circle | Offset | 2.00 | — | — | 1.00 | 0.17 | — |
| B | Circle | Offset | 1.75 | — | — | 1.00 | 0.18 | — |
| C | Regular Triangle | Offset | 1.80 | — | — | 0.50 | 0.21 | — |
| D | Regular Pentagon | Offset | 1.60 | — | — | 0.40 | 0.20 | — |
| E | Ellipse | Offset | 1.70 | 1.70 | 3.00 | 1.80 | 0.10 | 0.15 |
| F | Circle | Single-Radius | 2.00 | — | — | 0.00 | 0.17 | — |
| G | Regular Pentagon | Single-Slope | 1.60 | — | — | 0.00 | 0.20 | — |

TABLE 2

| | Composition of Dimples | Results of the Flying Test | | | |
|---|---|---|---|---|---|
| | | Carry (yds) | Run (yds) | Total (yds) | Elevation Angle of Trajectory (°) |
| Example 1 of the Present Invention | A(Circle) | 223.6 | 13.9 | 237.5 | 13.1 |
| Example 2 of the Present Invention | A(Circle) B(Circle) | 224.7 | 13.5 | 238.2 | 13.3 |
| Example 3 of the Present Invention | C(Regular Triangle) | 222.5 | 14.1 | 236.6 | 13.0 |
| Example 4 of the Present Invention | D(Regular Pentagon) | 223.1 | 13.9 | 237.0 | 13.1 |
| Example 5 of the Present Invention | A(Circle) E(Ellipse) | 223.9 | 14.2 | 238.1 | 13.2 |
| Conventional Product 1 | F(Circle) | 218.6 | 14.6 | 233.2 | 12.7 |
| Conventional Product 2 | G(Regular Pentagon) | 217.4 | 15.0 | 232.4 | 12.5 |

In Table 1, plane shape means a shape of each dimple in the dimple plane view, offset in a column of sectional shape means a case in which the dimple deepest portion does not correspond to the center of the dimple, single-radius means a case in which the dimple deepest portion corresponds to the center of the dimple and the bottom face is a spherical curved surface, and single-slope means a case in which the dimple deepest portion corresponds to the center of the dimple and the bottom face is a slope.

And, as shown in FIG. 2, $L_1$ represents radius of each dimple in dimple A, dimple B, and dimple F, as shown in FIG. 3A and FIG. 4A, $L_1$ represents dimension from the center of the dimple to each apex in dimple C, dimple D, and dimple G, and as shown in FIG. 5A, $L_1$ represents radius of an arc portion on one side in plane view in dimple E. And, also in dimple E, $L_2$ represents radius of an arc portion on the other side in plane view, and $L_3$ represents distance between centers of the two arc portion.

And, as shown in FIG. 2, etc., L represents deviational quantity of the dimple deepest portion from the center of the dimple, $F_1$ represents depth of the dimple deepest portion in dimples except dimple E. And as shown in FIG. 5, $F_1$ also represents depth of the arc portion on one side, namely, depth of the shallowest portion of the slope portion in dimple E, and $F_2$ represents depth of the arc portion on the other side, namely, depth of the deepest portion of the slope portion.

Then, a golf ball comprising dimples of A in Table 1 (number of the dimples is 410) is used in example 1, a golf ball comprising dimples of combination of A and B in Table 1 (number of the dimples A is 210, and number of the dimples B is 200) is used in example 2, a golf ball comprising dimples of C in Table 1 (number of the dimples is 336) is used in example 3, a golf ball comprising dimples of D in Table 1 (number of the dimples is 336) is used in example 4, and a golf ball comprising dimples of combination of A and E in Table 1 (number of the dimples A is 352, and number of the dimples E is 80) is used in example 5. And conventional product 1 and conventional product 2 are also tested. A golf ball comprising dimples of F in Table 1 (number of the dimples is 410) is used as the conventional product 1, and a golf ball comprising dimples of G in Table 1 (number of the dimples is 336) is used as the conventional product 2.

As shown in Table 2, the examples 1 through 5 have superior flying ability (carry, run, total, and elevation angle of trajectory) in comparison with the conventional product 1 and 2. Each golf ball is hit eight times by a hitting machine (a machine for shooting balls produced by True Temper Co., Ltd.), and an average value of the eight hits is shown in Table 2.

Thus, in the above examples 1 through 5, the deepest portion of the dimple is not necessarily positioned nearer to the seam S than the center of the dimple, since the deepest portion of the dimple is arranged freely (at random) to the seam S. In next example 6 and 1, however, as shown in Table 3, the angle between the straight line which goes through the dimple deepest portion and the center of the dimple and the great circle zone which goes through the poles and the center of the dimple is defined, and the deepest portion of each dimple is positioned nearer to the seam than the center of the dimple.

Further, the golf balls of examples 6 and 7, and the golf balls of comparison examples 1 and 2 are tested about carry and elevation angle of trajectory in cases of pole-hitting and seam-hitting. In these cases, each golf ball is hit 24 times by the hitting machine (the machine for shooting balls produced by True Temper Co., Ltd.) and an average value of the 24 hits is shown in Table 4.

TABLE 4

| | | Carry (yds) | Elevation Angle of Trajectory(°) |
|---|---|---|---|
| Example 6 of the Present Invention | Pole-Hitting | 252.6 | 12.66 |
| | Seam-Hitting | 252.2 | 12.61 |
| | Difference(Pole − Seam) | 0.4 | 0.05 |
| Example 1 of the Present Invention | Pole-Hitting | 250.3 | 12.18 |
| | Seam-Hitting | 251.0 | 12.12 |
| | Difference(Pole − Seam) | 0.7 | 0.06 |
| Comparison Example 1 | Pole-Hitting | 249.1 | 12.51 |
| | Seam-Hitting | 245.8 | 12.18 |
| | Difference(Pole − Seam) | 3.3 | 0.33 |
| Comparison Example 2 | Pole-Hitting | 247.6 | 12.55 |
| | Seam-Hitting | 244.8 | 12.28 |
| | Difference(Pole − Seam) | 2.8 | 0.27 |

The example 6 and 7 have smaller differences between the cases of pole-hitting and seam-hitting in comparison with that of the comparison examples 1 and 2. That is to say, there is no discrepancy of flying ability of a golf ball caused by the difference of the rotational axis based on the difference of hitting points on the golf ball, the golf ball has good aerodynamic symmetrical quality, and the golf ball reflects players' skill accurately.

TABLE 3

| | Kind of Dimples | Number of Dimples | Total Number of Dimples | Diameter of Dimples (mm) | Offset Dimension (mm) | Angle δ (°) |
|---|---|---|---|---|---|---|
| Example 6 of the Present Invention | ① | 50 | 410 | 4.30 | 1.30 | 0 to 70 |
| | ② | 210 | | 3.80 | 1.20 | 0 to 82 |
| | ③ | 110 | | 3.50 | 1.40 | 20 to 53 |
| | ④ | 40 | | 3.30 | 1.20 | 0 |
| Example 7 of the Present Invention | ⑤ | 168 | 336 | 4.00 | 1.30 | 0 to 80 |
| | ⑥ | 168 | | 2.80 | 1.00 | 0 to 60 |
| Comparison Example 1 | a | 50 | 410 | 4.30 | 1.30 | 100 to 180 |
| | b | 210 | | 3.80 | 1.20 | 120 to 180 |
| | c | 110 | | 3.50 | 1.40 | 150 to 180 |
| | d | 40 | | 3.30 | 1.20 | 180 |
| Comparison Example 2 | e | 168 | 336 | 4.00 | 0.00 | — |
| | f | 168 | | 2.80 | 0.00 | — |

That is to say, as shown in Table 3, a golf ball of the example 6 comprises dimples of 4 kinds of ① through ④, a golf ball of the example 7 comprises dimples of 2 kinds of ⑤ and ⑥, a golf ball of a comparison example 1 comprises dimples of 4 kinds of a through d, and a golf ball of a comparison example 2 comprises dimples of 2 kinds of e and f . In this case, all of the dimples are circular, offset dimension in Table 3 is the deviational quantity of the dimple deepest portion from the center of the dimple, and angle δ is an angle between the straight line which goes through the dimple deepest portion and the center of the dimple and the great circle zone which goes through the poles and the center of the dimple.

As the golf balls of the examples described above, of the comparison examples described above, and of the conventional products described above, large-size two-piece balls are used.

Therefore, according to the present invention, air scraping effect can be increased, air flow around a golf ball is greatly disturbed, aerodynamic characteristic of the golf ball is improved, and flying distance of the golf ball can be increased thereby.

And the discrepancy of trajectory between the cases of pole-hitting and seam-hitting disappears, and the golf ball has good aerodynamic symmetrical quality. That is to say, the golf ball does not generate differences in height of trajectory, flying time, and flying distance, wherever the hitting point is on the golf ball.

While preferred embodiments of the present invention have been described in this specification, it is to be understood that the invention is illustrative and not restrictive, because various changes are possible within the spirit and indispensable features.

What is claimed is:

1. A golf ball having a spherical surface comprising:

dimples on said spherical surface, wherein a deepest portion of each of said dimples does not correspond to a center of each of said dimples as viewed in a radial direction toward a center of the golf ball, and depth of each of said dimples diminishes gradually and monotonically from the deepest portion to a radially outer portion.

2. A golf ball having a spherical surface comprising:

dimples on said spherical surface, wherein more than 50% of said dimples each has a deepest portion that does not correspond to a center thereof as viewed in a radial direction toward a center of the golf ball, and depth of each of said dimples diminishes gradually and monotonically from the deepest portion to a radially outer portion.

3. A golf ball having a spherical surface comprising:

dimples on said spherical surface, wherein more that 90% of said dimples each has a deepest portion that does not correspond to a center thereof as viewed in a radial direction toward a center of the golf ball, and depth of each of said dimples diminishes gradually and monotonically from the deepest portion to a radially outer portion.

4. A golf ball having a spherical surface comprising:

dimples on said spherical surface, wherein a deepest portion of each of said dimples does not correspond to a center of each of said dimples as viewed in a radial direction toward a center of the golf ball;

a cross acute angle, between, a straight line which goes through the deepest portion and the center of each of said dimples, and a great circle zone which goes through poles and the center of each of said dimples, arranged to be −85° to 85°;

the deepest portion positioned nearer to a seam than the center; and depth of each of said dimples diminishes gradually and monotonically from the deepest portion to a radially outer portion.

5. A golf ball having a spherical surface comprising:

dimples on said spherical surface, wherein more than 50% of said dimples each has a deepest portion that does not correspond to a center thereof as viewed in a radial direction toward a center of the golf ball;

a cross acute angle, between, a straight line which goes through the deepest portion and the center of each of said dimples, and a great circle zone which goes through poles and the center of each of said dimples, arranged to be −85° to 85°;

the deepest portion positioned nearer to a seam than the center; and depth of each of said dimples diminishes gradually and monotonically from the deepest portion to a radially outer portion.

6. A golf ball having a spherical surface comprising:

dimples on said spherical surface, wherein more than 90% of said dimples each has a deepest portion that does not correspond to a center thereof as viewed in a radial direction toward a center of the golf ball;

a cross acute angle, between, a straight line which goes through the deepest portion and the center of each of said dimples, and a great circle zone which goes through poles and the center of each of said dimples, arranged to be −85° to 85°;

the deepest portion positioned nearer to a seam than the center; and depth of each of said dimples diminishes gradually and monotonically from the deepest portion to a radially outer portion.

7. The golf ball as set forth in claim 1, 2, 3, 4, 5 or 6, wherein the dimple in which the dimple deepest portion does not correspond to the center of the dimple is circular as viewed in radial direction toward the center of the sphere.

8. The golf ball as set forth in claim 1, 2, 3, 4, 5 or 6, wherein the dimple in which the dimple deepest portion does not correspond to the center of the dimple is elliptic as viewed in radial direction toward the center of the sphere.

9. The golf ball as set forth in claim 1, 2, 3, 4, 5 or 6, wherein the dimple in which the dimple deepest portion does not correspond to the center of the dimple is regular polygonal as viewed in radial direction toward the center of the sphere.

* * * * *